US005139355A

United States Patent [19]

Yeager

[11] Patent Number: 5,139,355

[45] Date of Patent: Aug. 18, 1992

[54] PRINTER WITH MULTI-TRACTOR FORM SHUTTLE

[75] Inventor: Thomas C. Yeager, St. Joseph, Mich.

[73] Assignee: Printek, Inc., Benton Harbor, Mich.

[21] Appl. No.: 701,095

[22] Filed: May 16, 1991

[51] Int. Cl.[5] ..... B41J 11/26

[52] U.S. Cl. ..... 400/616.1; 400/605; 226/108; 226/174; 226/188

[58] Field of Search ..... 400/616.1, 616.2, 605, 400/606, 607; 226/170, 171, 172, 174, 188, 189, 190, 108, 109, 110, 117, 116

[56] References Cited

U.S. PATENT DOCUMENTS

| | | | |
|---|---|---|---|
| 2,862,708 | 12/1958 | Allen . | |
| 3,334,722 | 8/1967 | Bernard | 400/616.1 |
| 3,987,886 | 10/1976 | Mahoney et al. | 400/55 |
| 4,390,296 | 6/1983 | Siegenthaler . | |
| 4,742,946 | 5/1988 | Hamamichi et al. | 400/605 |
| 4,808,019 | 2/1989 | Olson et al. . | |
| 4,929,104 | 5/1990 | Yokoi et al. . | |
| 4,974,979 | 12/1990 | Cardenas . | |
| 4,988,226 | 1/1991 | Ito | 400/616.1 |

FOREIGN PATENT DOCUMENTS

| | | | |
|---|---|---|---|
| 2164215 | 1/1980 | Fed. Rep. of Germany | 400/616.1 |
| 0063464 | 4/1986 | Japan | 400/616.1 |
| 0188169 | 8/1986 | Japan | 400/616.2 |
| 0009868 | 1/1991 | Japan | 400/605 |
| 0015573 | 1/1991 | Japan | 400/605 |

OTHER PUBLICATIONS

Epson DFX-5000 Promotional Material 1988, CPD-733-1R-Dec.-1000,000-1818-Rice.

Genicom Model 3800 Promotional Material Oct. 1988, Geni-337-Oct. 1988.

"Adjuster Cable Arrangement for Forms Tractors" IBM Tech. Discl. Bulletin, vol. 29, No. 12, May 1987, pp. 5518-5519.

*Primary Examiner*—Eugene H. Eickholt

*Attorney, Agent, or Firm*—Cook, Egan, McFarron & Manzo

[57] ABSTRACT

A multi-tractor shuttle printer having an array of moveable tractors such that a selected tractor and form can be shuttled into, and out of, position for printing. A drive motor is linked via cable to the tractors to shuttle them into and out of position. Guide plates located on each side of the array of tractors have guide slots into which a guide rod from each tractor fits. Movement through the path of the guide slots is controlled by a pair of flippers located in each guide plate. When a tractor is driven to the engaged position, it engages a main drive gear which controls transportation of a continuous form through the engaged tractor into the printer.

20 Claims, 3 Drawing Sheets

PRINTER WITH MULTI-TRACTOR FORM SHUTTLE

BACKGROUND OF THE DISCLOSURE

The present invention relates to a printer and, more particularly, to a continuous form printer whereby a number of different forms can be simultaneously loaded in the printer and a chosen form can be selectively shuttled into position for printing.

Continuous forms have a series of sheets with evenly spaced holes along their lateral edges. The sheets are usually separated by perforated lines so that they can be conveniently detached from one another. A printer is adapted to handle such continuous forms by the use of a tractor, which typically has a pair of formhandling jaws containing sprocketed belts that can be controllably driven or rotated. The jaws are positioned to line up with the lateral edges of a form so that the holes of the form can be aligned with, and engaged by, the tractor sprockets. The form can then be transported through the tractor by rotating the sprocketed belts. A tractor can be located in a printer either before the actual printing apparatus (typically the combination of a platen and print head) such that forms are fed into the printer, or the tractor can be located after the printing apparatus so that forms are drawn through the printer. Tractors are particularly useful for handling pre-printed continuous forms because they provide for consistent and accurate positioning of each form thereby allowing matter to be printed reliably in the correct place on the forms.

Most printers accommodate only a single type of continuous form at any given time. Consequently, whenever it is desired to use a different form, the user must unload the current form from the printer and load the new one. Changing forms can be time consuming and inefficient, especially for those who regularly use several different forms.

Continuous forms also often have multiple layers or parts so that copies of the form being printed are made simultaneously. Such multiple part forms are more difficult for printers to handle, though, because they are stiffer than single layer forms and their layers can delaminate when the form is forced to curve or bend at too great an angle. Because of this, many forms makers recommend that their multiple part forms not be used with rear-fed printers, which require bending the form at approximately 90° during transport to the print head. Consequently, it is desirable to provide a print path for the forms which requires as little bending as possible.

Accordingly, it is a principal object of the present invention to provide a multiple form printer where continuous forms travel in a generally straight up print path.

A related object is to provide a simple and reliable mechanism for shuttling a selected tractor and form into position for printing.

Another object is to provide a printer which allows convenient access to load and unload continuous forms into and out of the tractors.

These objects, as well as others that will become apparent upon reference to the accompanying drawings and following detailed description, are provided by a printer which includes an array of movable tractors. The tractors are movably mounted in a frame and each tractor can be operated by a main tractor rotating drive. The tractors are moved to various positions by a shuttle drive, and a guide mechanism provides a guide path whereby each respective tractor can occupy the print position. When a tractor is in the print position, the leading edge of a continuous form transported through that tractor is fed into the printer. The tractor shuttle arrangement also permits each of the different forms to travel a path so that it passes straight through the platen when that form is selectively moved into the print position.

Preferably the platen, carriage, and print head of the printer are located in a hinged upper casing which can be tilted up away from the tractor shuttle frame and apparatus to facilitate loading continuous forms into the tractors.

BRIEF DESCRIPTION OF THE DRAWINGS

In describing the preferred embodiment, reference is made to the accompanying drawings wherein:

FIG. 3 shows the guide rods as the front tractor guide rod has just passed under the first flipper;

FIG. 4 shows the guide rods after the front tractor guide rod has just been backed up the arm of the first flipper;

FIG. 5 shows the guide rods after the front tractor guide rod has been shuttled forward and driven up the arm of the second flipper into the print position; and FIG. 6 shows the guide rods after the front tractor guide rod has been disengaged from the print position and the middle tractor guide rod is now in position to be backed up the first flipper arm.

DETAILED DESCRIPTION OF THE PREFERRED EMBODIMENT

Figure 1:
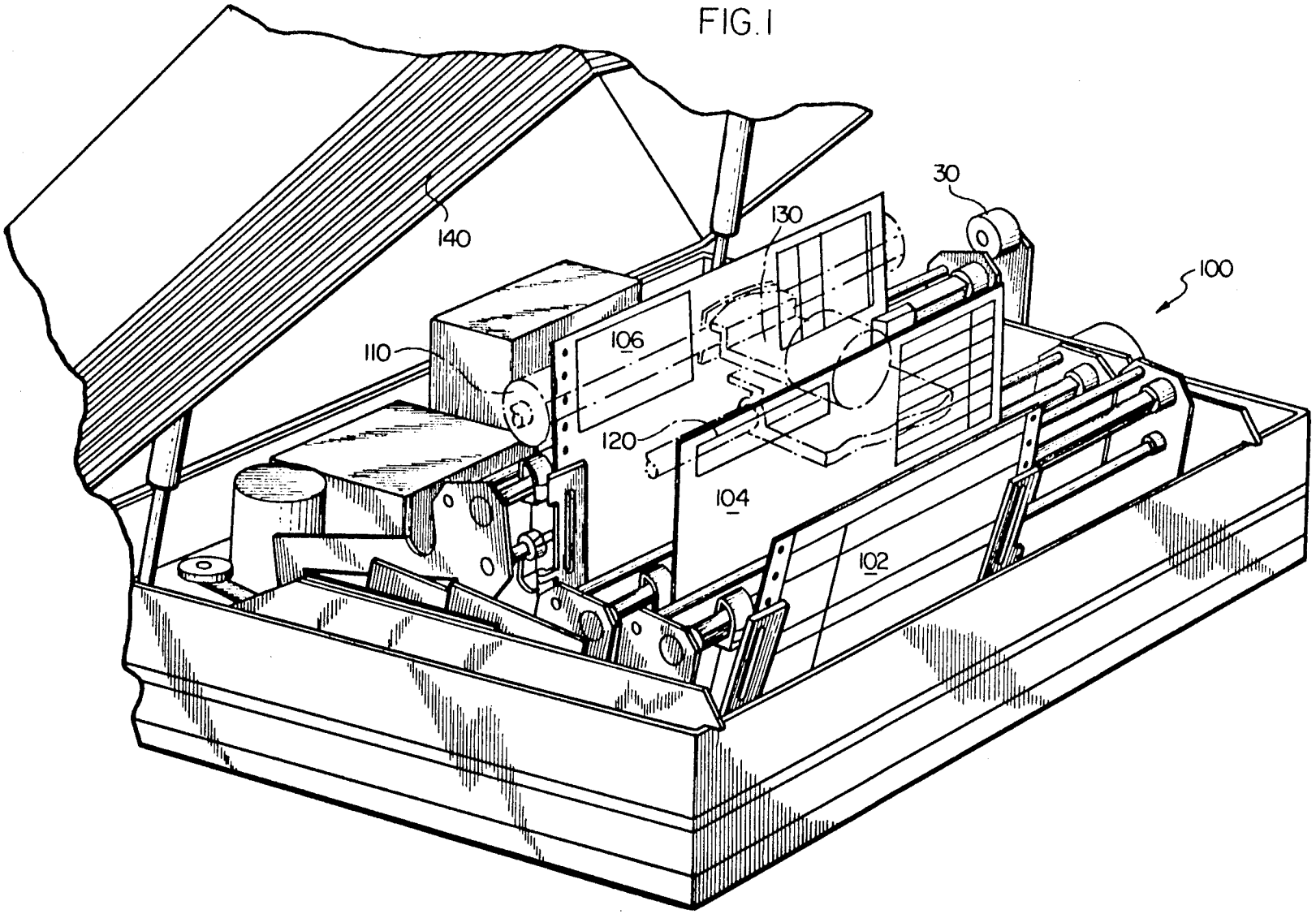
FIG. 1 is a front perspective view of a printer incorporating the present invention where the rear tractor occupies the print position.

Turning to the figures of the drawings, there is seen in FIG. 1 a printer incorporating a multi-tractor shuttle apparatus according to the present invention, generally indicated by 100, for simultaneously holding three different forms 102, 104, 106 and shuttling a selected tractor mechanism into position for printing the associated form. A tractor in the print position is located such that a form travelling through it is fed between the printer platen 110 and print head 130. In FIG. 1 the rear-most tractor, with continuous form 106, is shown occupying the print position. Preferably platen 110 rotates in coordination with the actively printing tractor so as to provide a certain amount of friction drive to help transport the form through the printer. Also in accordance with the preferred embodiment, the platen 110, carriage 120, print head 130, and associated apparatus are mounted in upper casing 140, which can be lifted to facilitate loading the tractors with continuous forms. When the upper casing is lowered into operating position the print apparatus is located as indicated by dashed lines in FIG. 1. In the preferred embodiment, platen 100 is a rubber roller and print head 130 is an 18 pin dot matrix impact printer head which rides on carriage 120, as is well known in the art.

The forms are preferably supplied from a cabinet (not shown) below the printer, rather than behind the printer. This is important because, as mentioned earlier, multi-part continuous forms often become delaminated and jam when run in a rear-feed system where they must turn a 90 degree angle along the printer platen. The straight up print path possible with the present invention drastically increases the reliability of the printer operation. The multi-tractor shuttle apparatus shown in FIG. 1 as incorporated in printer 100 is best seen separately in FIG. 2, as generally indicated by 10.

Figure 2:
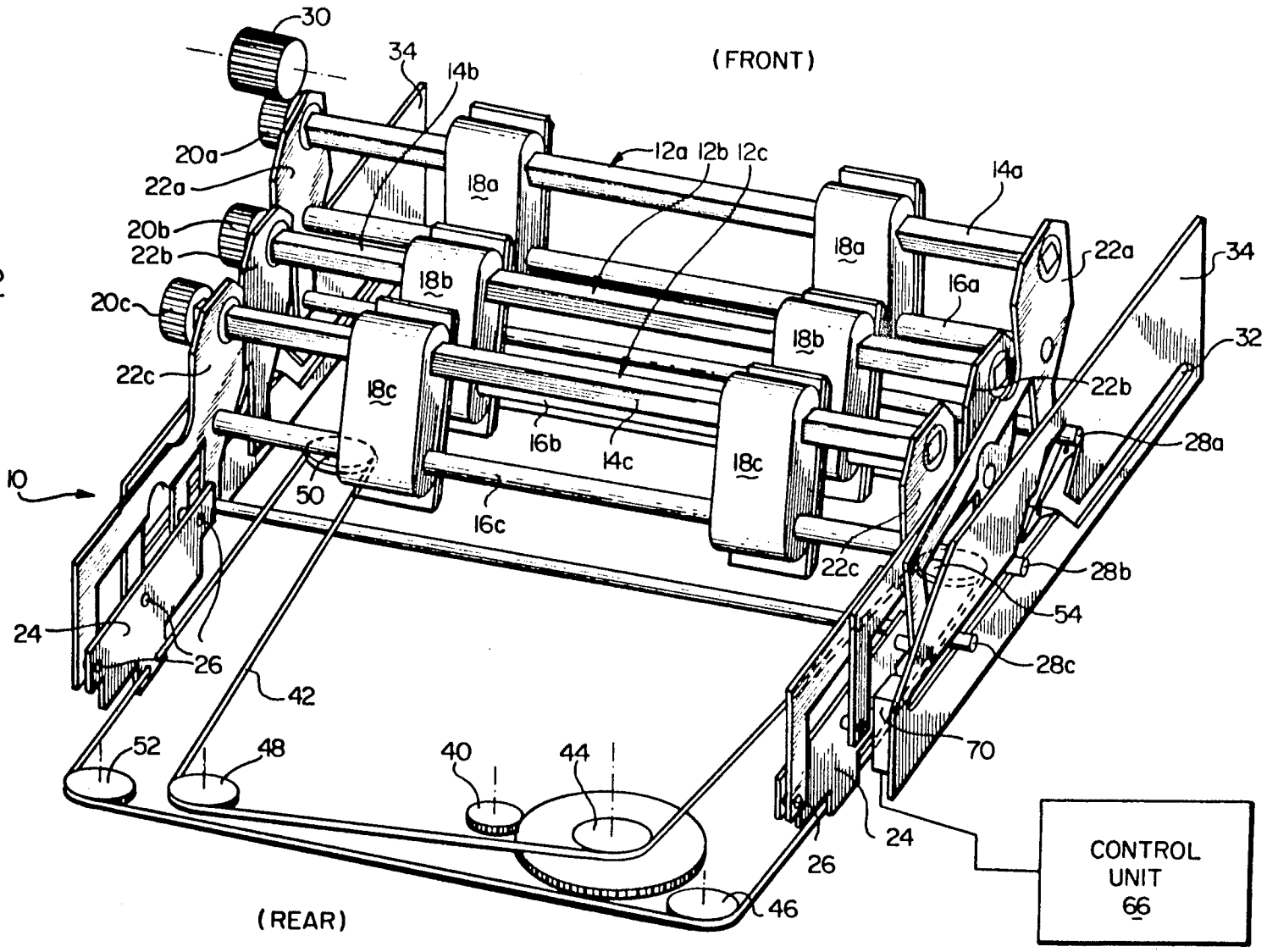
FIG. 2 is a rear perspective view of the shuttle assembly according to the present invention.

Each of the three tractors 12*a*, 12*b*, 12*c* in FIG. 2 is made up of a tractor drive rod 14*a*, 14*b*, 14*c* a clamp rod 16*a*, 16*b*, 16*c* and a pair of form-handling jaws 18*a*, 18*b*, 18*c* which engage and drive a continuous form through the tractor, as is well known in the art. A drive gear 20*a*, 20*b*, 20*c* is located on one end of each rod 14*a*, 14*b*, 14*c*. When a particular tractor occupies the print position, its drive gear 20 meshes with the main tractor drive gear 30, so that rotation of the main tractor drive gear 30 rotates the tractor drive rod 14 and thereby rotates the sprockets (not shown) of the form-handling jaws 18. One or both of the form-handling jaws 18 on each tractor can be slid axially along rods 14 and 16 to match the width of a particular continuous form, as best seen in FIG. 1. A clamp (not shown) locks the slidable jaws into place.

In keeping with the invention, means are provided for selectively placing the various tractor mechanisms along with their associated forms into the print position. As best seen in FIG. 2, pivot plates 22*a*, 22*b*, 22*c* are attached on both ends of each tractor, but still allow drive rods 14*a*, 14*b*, 14*c* to rotate. Each of the three pivot plates 22*a*, 22*b*, 22*c* on both sides of each tractor are pivotally attached to shuttle plates 24 via pivot posts 26. Attachment of the pivot plates 22 to the shuttle plates 24 in this manner allows each tractor a certain degree of independent motion in an arc around the axis of its pivot posts, while concurrently tying all three tractors 12 together so they can be shuttled forward or backward simultaneously (by driving the shuttle plates 24).

Each tractor 12 also has associated with it a guide rod 28*a*, 28*b*, 28*c* running parallel to the other tractor rods 14*a*, 14*b*, 14*c* and 16*a*, 16*b*, 16*c* and extending through the tractor pivot plates 22*a*, 22*b*, 22*c*. The tips of guide rods 28*a*, 28*b*, 28*c* fit within the guide path slot 32 of stationary guide plates 34, thereby restricting tractor movement to a particular path. In the preferred embodiment, slot 32 has three branches—one extends forward, one backward, and one generally upward. Thus, it can be seen in FIG. 2 that three tractors 12*a*, 12*b*, 12*c* are mounted within a frame (not shown) in such a way that they are moveable front to back and, to some extent, up and down through a controlled path of movement.

Also in accordance with the preferred embodiment of the present invention and as best seen in FIG. 2, a shuttle drive gear 40 meshes with a cable drive wheel 44. Cable 42 is wrapped around and positively driven by wheel 44, and is connected via pulleys 46, 48, 50, 52, and 54 to shuttle plates 24. Drive gear 40 is controllably rotated by a stepper motor (not shown). By rotating drive gear 40 counter clockwise, and thus cable drive wheel 44 clockwise, the tractor shuttle plates 24 are driven forward simultaneously; reversing the motor drives the shuttle plates backwards simultaneously. In this way, the forward and rearward movement of the three tractors 12 can be controlled as a unit, while each tractor still pivots individually on the shuttle plates 24.

In keeping with another aspect of the present invention, a set of flippers 60 and 62, as best seen in FIGS. 3–6, are located in the guide path slot of each stationary guide plate 34. The first flipper 60 is rotationally biased by a coiled spring (not shown) such that its forward arm presses against the lower surface of guide plate slot 32. The second flipper 62 is rotationally biased in the opposite direction such that its rearward arm presses near the apex 61 of the first flipper 60.

Figure 3:
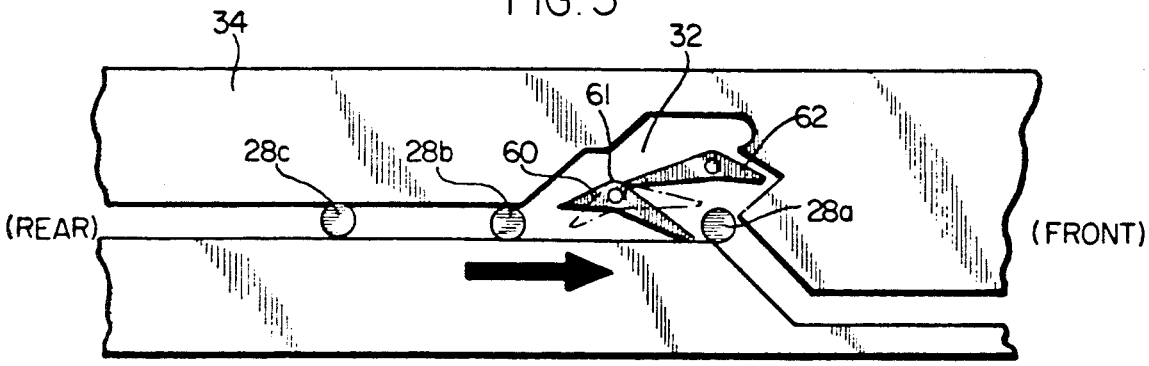
FIGS. 3–6 are schematic end views of tractor guide rods as they are shuttled into various positions through a guide path slot and flipper mechanism; more particularly
Figure 4:
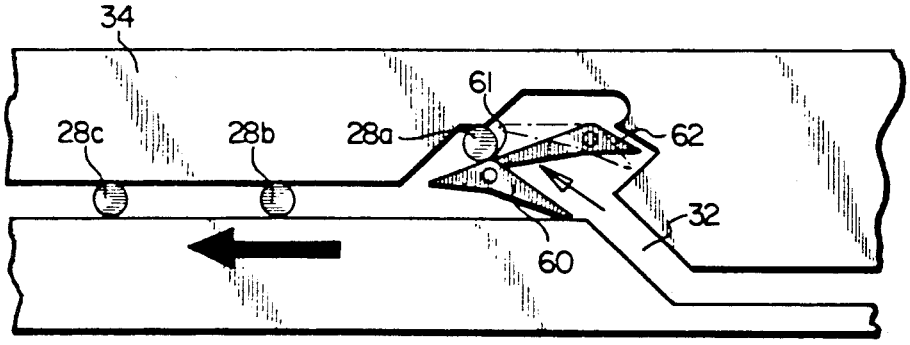
Figure 5:
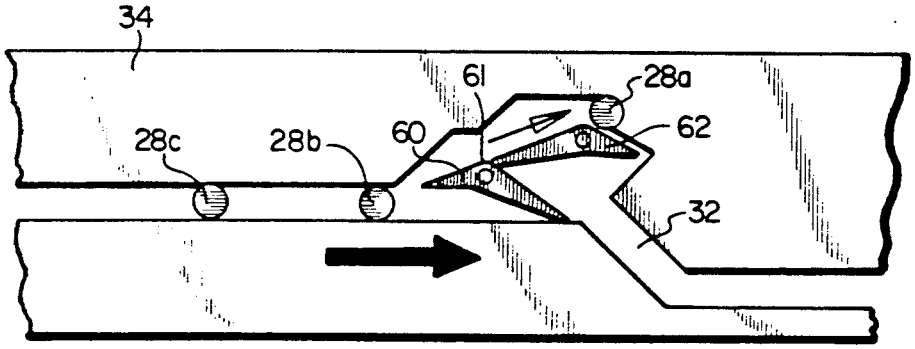

FIGS. 3–5 show a sequence of movements whereby the front tractor 12*a* is shuttled into the print position. In FIG. 3 the tractors have been shuttled forward (in accordance with the shuttling drive mechanism described above) such that the guide rod 28*a* of the front tractor has just passed under and cleared the first flipper 60, and flipper 60 has returned to its starting position. The shuttle drive motor (not shown) is then reversed and the tractors are moved rearward. This drives the front guide rod 28*a* backward up the arm of flipper 60, as best seen in FIG. 4. The direction of the shuttle drive motor is again reversed and the front tractor guide rod 28*a* is driven forward up the arm of flipper 62 and lodged in the print position, as best seen in FIG. 5.

Figure 6:
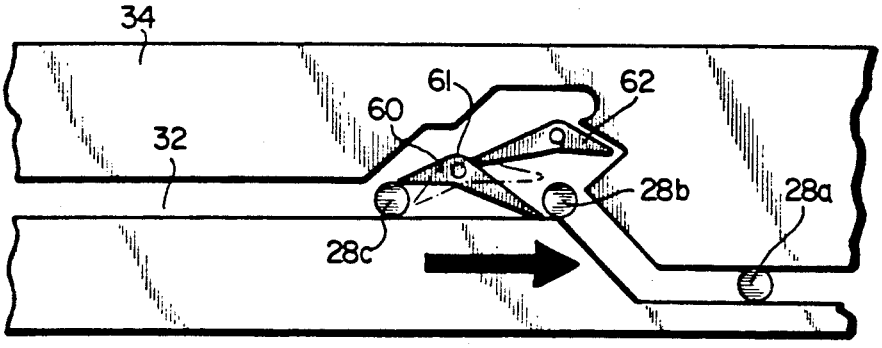

A tractor is dislodged from the print position by shuttling the tractors backwards, thereby backing the guide rod down the flippers (not shown). As best seen in FIG. 6, when tractor 28*b* is to be moved into position for printing, the guide rods are shuttled forward until the selected tractor's guide rod is in position just ahead of the first flipper 60. The selected tractor is then maneuvered up into the print position as shown in FIGS. 3–5. Also, when a new form is selected, which is done by either pressing a button on the printer (not shown) or by software control from an attached computer (not shown), the form previously engaged for printing is first automatically backed out from the printer platen before the newly selected form is shuttled into position.

The above-described operation of shuttling a selected tractor into the print position requires accurate movement and control of the shuttling apparatus. To help avoid the need for high tolerance parts, which would increase the cost, a microswitch 70 is used for self-calibration purposes, as best seen in FIG. 2. The microswitch 70 senses when it is actuated by the rear guide rod 28*c*, thus providing a reference point from which an electronic control unit 66 (shown schematically) can calculate how far the shuttle drive motor must drive the shuttle plates in order to properly position the selected tractor guide.

From the foregoing, it can be seen that a multi-tractor shuttle apparatus for holding a number of forms loaded simultaneously and printing a selected form has been provided which fully meets the objects of the present invention. While the apparatus has been described in terms of a preferred embodiment, there is no intent to limit the invention to the same. On the contrary, it is intended to cover all modifications and equivalents within the scope of the appended claims.

It will be apparent to one skilled in the art that many variations could be made within the scope of the present invention. For example, although the preferred embodiment utilizes an 18 pin print head because it works well with multiple part forms, other methods of printing could be used, such as thermal printing. Also, different numbers of tractors could be used under the present invention. Moreover, there is no intent to limit the present invention to an array of tractors disposed in a roughly horizontal row, as in the preferred embodiment. The tractors could be placed in many other orientations and shuttled into a print position.

What is claimed is:

1. In a printer, a multi-tractor shuttle apparatus for selectively feeding a plurality of continuous forms to the printer, comprising, in combination:

a frame;

a main tractor rotating drive for controllably operating a tractor to transport a continuous form to the printer;

an array of tractors movably mounted within said frame and engageable by said main tractor rotating drive, each tractor for handling a continuous form;

tractor shuttle drive means coupled to said movably mounted tractors, adapted to controllably direct said tractors through a range of movement; and a guide mechanism associated with said frame which engages said array of movable tractors and provides a guide path allowing each respective tractor to occupy position for printing such that the leading edge of a form transported through the engaged tractor is fed into the printer.

2. The multi-tractor shuttle apparatus of claim 1 wherein said array of movable tractors comprises three tractors arranged in a generally horizontal row.

3. The multi-tractor shuttle apparatus of claim 1 wherein said main tractor rotating drive includes a drive gear and each tractor in said array includes a drive rod, a gear attached to one end of said drive rod which meshes with said main tractor rotating drive gear when the tractor is in the print position and whose rotation drives the tractor so as to allow controllable translation of a form through the tractor, a clamp rod, and a pair of formhandling jaws having sprocketed belts which cooperate with the holes of a continuous form.

4. The multi-tractor shuttle apparatus of claim 1, wherein said tractor shuttle drive means includes:

first and second sets of pivot plates, with a separate pivot plate being attached to both ends of each tractor, all the pivot plates of said first set being attached to the tractor ends located toward one side of the printer and all the pivot plates of said second set being attached to the tractor ends located toward the opposite side of the printer;

first and second shuttle plates, with all the plates of said first set of pivot plates being pivotally attached to said first shuttle plate and all the plates of said second set of pivot plates being attached to said second shuttle plate such that simultaneous movement of said first and second shuttle plates in the same direction causes coordinated movement of said array of moveable tractors; and means for driving said shuttle plates.

5. The multi-tractor shuttle apparatus of claim 1 wherein each tractor of said array of tractors includes a guide rod protruding axially from the ends of the tractor, and said guide mechanism includes a pair of stationary guide plates having a guide path slot, said guide path slots being adapted to receive the guide rods associated with said array of movable tractors.

6. The multi-tractor shuttle apparatus of claim 5, wherein said guide path slots have first, second, and third branches, said first branch extending generally forward of the intersection of the three branches, said second branch extending generally rearward of the intersection of the three branches, and said third branch extending generally upward and providing a position such that a tractor whose guide rod is lodged in the third branch is in position for printing.

7. The apparatus of claim 6, further including first and second flippers located at the intersection of said three guide slot branches and adapted for directing the travel of the tractor guide rods into selected branches.

8. A printer having a frame, a carriage attached to said frame, a printhead mounted to said carriage, a platen attached to said frame for accurately positioning a form relative to said carriage and printhead, and means for controllably driving said carriage and platen, the improvement comprising an array of moveable tractors associated with said printer adapted to simultaneously hold a plurality of continuous forms, and a drive mechanism controllably connected to said array of movable tractors for controllably shuttling selected tractors and forms into an out of position for printing.

9. In a printer, a multi-tractor shuttle apparatus for selectively feeding a plurality of continuous forms to the printer, comprising, in combination:

a frame;

a main tractor rotating drive for controllably operating a tractor to transport a continuous form to the printer;

an array of tractors movably mounted within said frame and engageable by said main tractor rotating drive, each tractor for handling a continuous form and each tractor of said array of tractors including a guide rod protruding axially from the ends of the tractor;

first and second sets of pivot plates, with a separate pivot plate being attached to both ends of each tractor, all the pivot plates of said first set being attached to the tractor ends located toward one side of the printer and all the pivot plates of said second set being attached to the tractor ends located toward the opposite side of the printer;

first and second shuttle plates, with all the plates of said first set of pivot plates being pivotally attached to said first shuttle plate and all the plates of said second set of pivot plates being attached to said second shuttle plate such that simultaneous movement of said first and second shuttle plates in the same direction causes coordinated movement of said array of moveable tractors;

a guide mechanism associated with said frame including a pair of stationary guide plates each having a guide path slot which engages said guide rods of each tractor of said array, said guide path slots including first, second, and third branches, said first branch extending generally forward of the intersection of the three branches, said second branch extending generally rearward of the intersection of the three branches, and said third branch extending generally upward and providing a position such that a tractor whose guide rod is lodged in the third branch is in position for printing so that the leading edge of a form transported through the tractor is fed into the printer;

means for directing a selected guide rod into said third branch for printing; and means for driving said shuttle plates.

10. The multi-tractor shuttle apparatus of claim 9, wherein said means for driving said shuttle plates includes a shuttle drive cable connected to said first and second shuttle plates and a drive motor positively engaging said shuttle drive cable for controllably moving said first and second shuttle plates, said first and second sets of pivot plates, and said array of movable tractors.

11. The multi-tractor shuttle apparatus of claim 9, wherein said means for directing a selected guide rod into said third branch for printing includes a pair of flippers disposed at the intersection of said first, second, and third branches.

12. A printer including a multi-tractor shuttle apparatus for simultaneously holding and selectively printing to a plurality of continuous forms, said multi-tractor shuttle apparatus comprising:

A plurality of tractors, each tractor for simultaneously holding a continuous form;

said plurality of tractors movably mounted in association with said printer such that each individual tractor, along with a continuous form, can be selectively shuttled into and out of a print position whereat rotation of the tractor translates said continuous form through the printer; and a tractor shuttle drive mechanism coupled to said plurality of tractors and adapted to controllably shuttle a selected tractor and form into position for printing.

13. The printer of claim 12, wherein said multi-tractor shuttle apparatus provides a straight-up paper path.

14. The printer of claim 12, wherein said printer only handles continuous forms.

15. The printer of claim 12, wherein said multi-tractor shuttle apparatus has three tractors and simultaneously holds three continuous forms.

16. The printer of claim 12, wherein said multi-tractor shuttle apparatus includes a guide plate having guide path track along which said plurality of tractors are shuttleable.

17. The printer of claim 16, wherein said guide path track extends generally horizontally when said printer is oriented in its normal operating position.

18. The printer of claim 16, wherein said guide path track includes a flipper mechanism for directing movement of said tractor.

19. The printer of claim 12, wherein said tractor shuttle drive mechanism includes a cable coupled to said plurality of tractors and a stepper motor driving said cable.

20. The printer of claim 12, further including a main tractor drive gear such that when a selected tractor is shuttled into position for printing it engages said drive gear which controllably rotates said tractor.

* * * * *